United States Patent [19]

Jantzen et al.

[11] 4,220,310

[45] Sep. 2, 1980

[54] EXTENSIBLE DISPLAY MOUNTING ASSEMBLY

[76] Inventors: Charles A. Jantzen, 190 Alps Rd.; L. Arthur Jantzen, 186 Fairfield Rd., both of Wayne, N.J. 07470

[21] Appl. No.: 59,282

[22] Filed: Jul. 20, 1979

[51] Int. Cl.[3] ..... A47F 13/06

[52] U.S. Cl. ..... 248/544; 294/19 R

[58] Field of Search ..... 248/544; 294/19 R, 22, 294/88

[56] References Cited

U.S. PATENT DOCUMENTS

| | | | |
|---|---|---|---|
| 1,716,232 | 6/1929 | Kantor | 294/19 R |
| 2,584,545 | 2/1952 | Caferro | 294/19 R X |
| 2,731,291 | 1/1956 | Bellini et al. | 294/19 R |
| 3,327,376 | 6/1967 | Freeman et al. | 294/19 R X |
| 3,477,757 | 11/1969 | English | 294/19 R |
| 3,561,718 | 2/1971 | Iverson | 294/19 R X |
| 3,936,088 | 2/1976 | Williams | 294/19 R |
| 4,063,768 | 12/1977 | Denis | 294/19 R |
| 4,079,978 | 3/1978 | McMullin | 294/19 R |

*Primary Examiner*—J. Franklin Foss

*Attorney, Agent, or Firm*—Nims, Howes, Collison & Isner

[57] ABSTRACT

The invention relates to an extensible display mounting device that includes a telescoping pole assembly that can be extended to an appropriate desired length and having at its extensible end selectively shaped fixtures for releasably positioning a magnetically adherable mounting member adapted to support a display device suspended therefrom.

4 Claims, 5 Drawing Figures

EXTENSIBLE DISPLAY MOUNTING ASSEMBLY

BACKGROUND OF THE INVENTION

This invention relates to an extensible display mounting assembly and particularly to an extensible device for the releasable mounting of advertisements, posters, decorations or other display devices at elevated locations from ground level.

The hanging of posters, advertisements, decorations or other display material at elevated locations in retail stores or the like conventionally requires the use of a ladder, such as a step ladder, with its attendant hazards and with such hazards being exacerbated where the surface involved is, or is adjacent to, a glass window or other readily breakable material.

SUMMARY OF INVENTION

This invention may be briefly described as an extensible display mounting device that includes, in its broader aspects, a telescoping pole assembly that can be extended to an appropriate desired length and having at its extensible end selectively shaped fixtures for releasably positioning a magnetically adherable mounting member adapted to support a display device suspended therefrom.

The object of this invention is the provision of an improved device for effecting the releasable mountng of advertisements, posters, decorations or other display material at elevated locations from ground level.

Other objects and advantages of the subject invention will be apparent from the following portions of this specification and from the appended drawings which illustrate, in accord with the mandate of the patent statutes, a presently preferred embodiment of such device as presently contemplated by the applicant.

BRIEF DESCRIPTION OF THE DRAWINGS

FIG. 2 is an oblique view of the presently preferred magnetically adherable mounting device for displays or the like;

DESCRIPTION OF A PREFERRED EMBODIMENT

Figure 1:
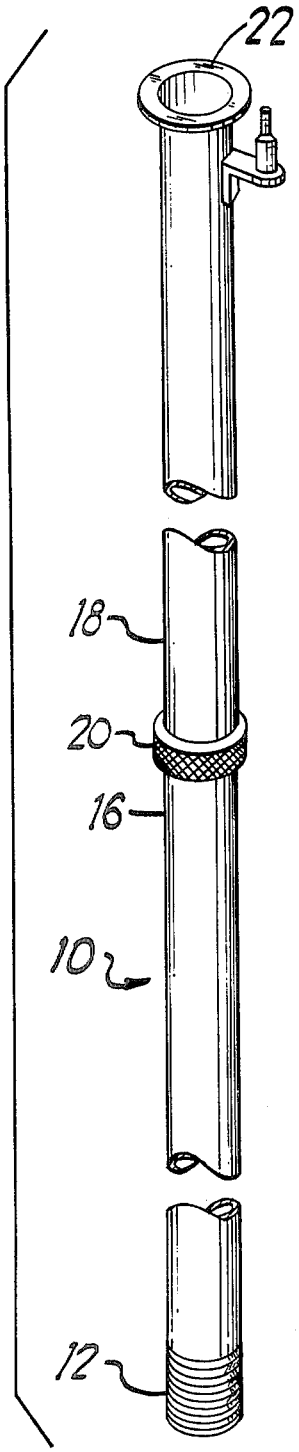
FIG. 1 is an oblique view of an extensible display mounting device constructed in accord with the principles of this invention.

Referring to the drawings, there is provided a light weight, telescopically extensible pole assembly 10, conveniently formed of two or more sections of aluminum alloy tubing and having a handle portion 12 at one terminal end thereof. The telescopic pole member 10 may be formed of two or more tube sections, as for example, tube sections 16 and 18, with suitable means, such as a plastic circumferential clutch 20 mounted on the end of the larger diameter tube section 16, to provide for locking the tubes in their extended position.

Figure 3:
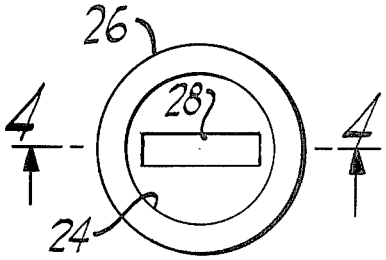
FIG. 3 is a plan view of a fixture disposed at the extensible end of the unit adapted to position a magnetically adherable device of the type shown in FIG. 2 in vertical orientation.

Fixedly mounted on the terminal end of the extendable tube section 18 is a cup member 22. At best shown in FIGS. 3 and 4, the cup member includes a body portion 24 sized to fit within the open end of the tube section 18, a perimetric flange portion 26 on the upper end thereof and a transverse slot 28 in the base thereof.

Figure 2:
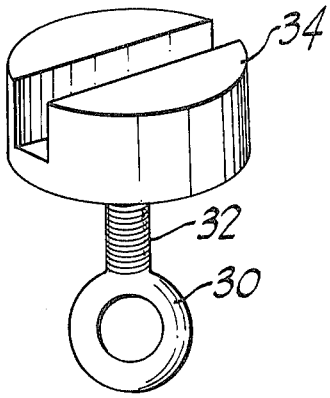

The transverse slot 28 in the base of the cup member 22 is sized to receive and pass the circular end 30 of a threaded eyebolt 32 forming a part of a magnetically adherable mounting device for displays and the like as shown in FIG. 2. As there shown the threaded end of the eyebolt 32 is threadedly secured to a small magnet 34, suitably formed of alnico or other high strength magnetic material.

Figure 5:
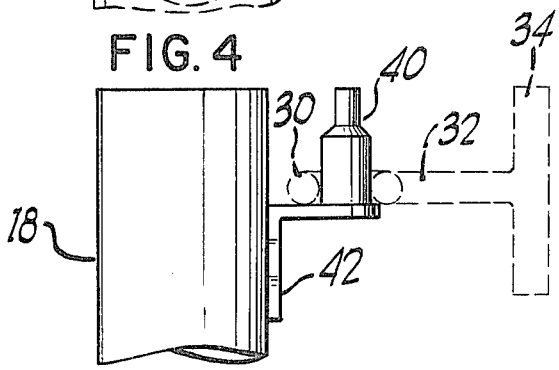
FIG. 5 is a side elevational view of a fixture disposed at the extensible end of the unit to position a magnetically adherable device of the type shown in FIG. 2 in horizontal orientation.

As best shown in FIG. 5, a finger or pin 40 is mounted adjacent the terminal end of the tube 18 and in spaced relation thereto by an angle bracket member 42. The pin 40 is designed with a cylindrical upper end and a cylindrical lower end mounted on the angle bracket member 42. The external diameter of the lower end of the pin 40 is greater than the external diameter of the upper end and is approximately equal to the internal diameter of the circular end of the eyebolt 30. The midsection of the pin 40 is beveled to facilitate the sliding of pin 40 through the circular end of the eyebolt 30.

In operation of the described device, a string or cord secured to a light weight display device such as an advertising placard or poster is secured to the eyebolt 32 intermediate the magnet 34 and the circular end 30 thereof.

Figure 4:
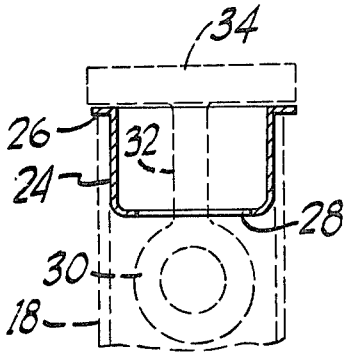
FIG. 4 is a sectional view as taken on the line 4—4 of FIG. 3.

If the magnet 34 is to be disposed in magnetically adherent engagement with a horizontal surface, the circular end portion 30 of the eyebolt 32 is introduced into the cup member 22 at the end of the tube section 18, and passed through the slot 28 in the base thereof so as to position the underside of the magnet 34 in abutting supportive relation on the perimetric flange 26 (as shown in dotted outline in FIG. 4). The magnet may be then rotated to radically offset the circular end portion 30 of the eyebolt 32 from the slot 38 and thus secure the magnet 34 in proper position relative to the cup member. With the eyebolt 32 having the display connected thereto in the manner described above so positioned, the tube 18 is extended to appropriate overall length and locked in extended condition by the clutch 20. In practice, an extensible overall length of between 6 and 12 feet has proven satisfactory for most contemplated usage thereof.

The extended pole assembly is then manipulated to place the exposed surface of the magnet 34 into magnetically adherent relation with a support member, which may be for example, a light fixture or other fixture, or a steel keeper strip mounted for display support purposes. The magnet 34 is disengaged from the cup member 22 by rotating the pole to bring the end portion 30 of the eyebolt into alignment with the slot 28. When so aligned and with the magnet 34 now adherent to a support member, the extended pole is lowered to disengage the magnet assembly and leave the latter at its elevated location.

To remove such a display-supporting eyebolt 32, the extended pole 10 is elevated until the circular end 30 of the eyebolt passes through the slot 28 in the cup member 22. When so positioned the pole and cup 22 are rotated to misalign the slot 28 and circular end 30 of the eyebolt 32, after which a downward pull on the extended pole will readily disengage the magnet 34 from the support structure.

If the magnet 34 is to be disposed in magnetically adherent relation with a vertical support surface, the circular end 30 of the eyebolt 32 will be mounted on the pin 40 (as shown in dottled outline in FIG. 5) so as to position the exposed surface of the magnet 34 into magnetically adherent relation with a support member. With the magnet 34 so engaged the pole is now manually lowered to disengage the circular end of the eyebolt 32 from the pin 40.

To remove such a vertically engaged display supporting eyebolt 32, the extended pole 10 is manually raised to insert the pin 40 into the circular end 30 of the eyebolt 32 to the full extent permitted. When so engaged a twisting torque applied by manipulation of the remote end of the extended pole 10 will break the magnetic adherence of the magnet 34 with the support structure. When so disengaged from the support structure, the entire eyebolt 32 assembly may be manually lowered.

It is understood that many modifications of the structure of the preferred embodiments will occur to those skilled in the art, and it is understood that this invention is to be limited only by the scope of the following claims.

I claim:

1. A display mounting assembly for releasably mounting light weight display materials at elevated locations, comprising:

a magnetically adherable mounting member including a magnet and a circular ring member disposed in spaced relation therewith;

telescopically extensible pole means;

a cup member mounted at the extensible end of said telescopically extensible pole means;

said cup member having a slotted base portion sized to selectivity pass said circular ring member therethrough and support said magnet in a first releasable position; and a pin member disposed in spaced parallel relation with the extensible end of said telescopically extensible pole means and peremetically engageable with said circular ring member to support said magnet in a second releasable position at substantially right angles to said first releasable position.

2. A display mounting assembly as set forth in claim 1 wherein said magnet and circular ring member are interconnected by a shaft to which said display is connected.

3. A display mounting assembly as set forth in claim 1 wherein said slotted base portion of said cup member is sized and shaped to pass said circular ring therethrough only when said ring is positioned in predetermined angular relation therewith.

4. A display mounting assembly as set forth in claim 1 wherein said telescopically extensible pole member is formed of at least two sections of non-magnetic tubing.

* * * * *